US009795859B2

(12) United States Patent
Heim

(10) Patent No.: US 9,795,859 B2
(45) Date of Patent: Oct. 24, 2017

(54) DYNAMIC SHIN GUARD

(71) Applicant: LEKISPORT AG, Baar (CH)

(72) Inventor: Eberhard Heim, Unterensingen (DE)

(73) Assignee: LEKISPORT AG, Baar (CH)

( * ) Notice: Subject to any disclaimer, the term of this patent is extended or adjusted under 35 U.S.C. 154(b) by 146 days.

(21) Appl. No.: 14/436,582

(22) PCT Filed: Sep. 18, 2013

(86) PCT No.: PCT/EP2013/069321
§ 371 (c)(1),
(2) Date: Apr. 17, 2015

(87) PCT Pub. No.: WO2014/060171
PCT Pub. Date: Apr. 24, 2014

(65) Prior Publication Data

US 2016/0166914 A1 Jun. 16, 2016

(30) Foreign Application Priority Data

Oct. 17, 2012 (CH) ..... 2022/12

(51) Int. Cl.
*A41D 13/00* (2006.01)
*A63B 71/12* (2006.01)
(Continued)

(52) U.S. Cl.
CPC ..... *A63B 71/1225* (2013.01); *A41D 13/0543* (2013.01); *A41D 13/06* (2013.01);
(Continued)

(58) Field of Classification Search
CPC .. A41D 13/0543; A41D 13/556; A41D 13/06; A41D 13/055; A63B 2071/1258;
(Continued)

(56) References Cited

U.S. PATENT DOCUMENTS 1,624,129 A * 4/1927 Barrett ..... A63B 71/1225 2/22
4,366,813 A * 1/1983 Nelson ..... A61F 5/0109 2/24

(Continued)

OTHER PUBLICATIONS

International Preliminary Report on Patentability dated Apr. 30, 2015, issued by the International Bureau in corresponding International Application No. PCT/EP2013/069321.

(Continued)

*Primary Examiner* — Katharine Gracz
(74) *Attorney, Agent, or Firm* — Sughrue Mion, PLLC

(57) ABSTRACT

A description is given of a shin guard (1) having a shin element (2) which is based on a hard plastics material or metal and has a concave inner side (16) which is curved transversally to a longitudinal axis (41) of the shin guard and encloses an interior (18) for accommodating a user's shin region. The shin guard is characterized in that at the lower end of the shin element (2), said lower end being directed towards the user's foot, it has a separate sliding element (3), which is based on a hard plastics material or metal and has a concave inner side (17), winch is adapted to the lower region of the shin element (2) and is curved transversally to the longitudinal axis (41) of the shin guard, as well as a convex outer surface (11), and in that the sliding element (3) is mounted such that it can be displaced dynamically essentially along the longitudinal axis (41), within defined limits, counter to a spring force directed towards the foot.

24 Claims, 4 Drawing Sheets

(51) Int. Cl.
*A41D 13/05* (2006.01)
*A41D 13/06* (2006.01)
*A63B 102/24* (2015.01)

(52) U.S. Cl.
CPC ... *A63B 2071/1258* (2013.01); *A63B 2102/24* (2015.10); *A63B 2225/09* (2013.01); *A63B 2244/19* (2013.01)

(58) Field of Classification Search
CPC ..... A63B 71/1225; A63B 2102/24; A63B 2102/22; A63B 2244/19; A63B 2225/096; A63B 2225/09
USPC ..... 2/22, 24
See application file for complete search history.

(56) References Cited

U.S. PATENT DOCUMENTS 4,450,832 A * 5/1984 Waddell ..... A61F 5/0104 2/22
4,617,920 A * 10/1986 Carsalade ..... A61F 5/0125 2/22
4,674,157 A * 6/1987 Litz ..... A63B 71/1225 2/22
4,692,946 A * 9/1987 Jurga ..... A63B 71/1225 2/22
5,107,823 A * 4/1992 Fratesi ..... A41D 13/0568 2/22
5,662,594 A * 9/1997 Rosenblatt ..... A61F 5/013 2/16
5,732,411 A 3/1998 Coleman et al.
5,898,939 A * 5/1999 Schramm ..... A41D 13/0153 2/22
6,128,779 A * 10/2000 Goldsmith ..... A41D 13/065 2/22
6,795,974 B1 * 9/2004 Howell ..... A41D 13/065 2/22
7,892,195 B2 * 2/2011 Grim ..... A61F 5/0585 128/846
2004/0083527 A1 * 5/2004 Budda ..... A41D 13/0568 2/22
2004/0260219 A1 * 12/2004 Jestrabek-Hart ..... A61F 5/0127 602/16
2006/0167396 A1 * 7/2006 Berger ..... A63B 71/1225 602/23
2006/0273531 A1 * 12/2006 Jenkins ..... A63C 17/006 280/11.19
2007/0250977 A1 * 11/2007 Brown ..... A41D 13/0543 2/22
2009/0018476 A1 * 1/2009 Cho ..... A61F 5/0123 602/16
2013/0263349 A1 * 10/2013 Roser ..... A43B 5/002 2/22

OTHER PUBLICATIONS

International Search Report of PCT/EP2013/069321, dated Oct. 17, 2013.

* cited by examiner

DYNAMIC SHIN GUARD

CROSS REFERENCE TO RELATED APPLICATIONS

This application is a National Stage of International Application No. PCT/EP 2013/069321 filed Sep. 18, 2013, claiming priority based on Swiss Patent Application No. 02022/12, filed Oct. 17, 2012, the contents of all of which are incorporated herein by reference in their entirety.

TECHNICAL FIELD

The present invention relates to the field of shin guards, in particular for sports activities in ski events (in particular downhill, giant slalom, and slalom), inline skating, ice hockey, American football, or in other types of sport where the shin has to be protected and, in particular, the transition area between foot and shin has to be optimally covered.

PRIOR ART

The known shin guards in this field are composed of a hard shin element which has a concave inner side, enclosing an interior of the shin guard, typically with a soft padding or foam, and which serves to receive the shin or lower leg of the user. At the lower edge, the shin guard is drawn down as far as possible, such that the lower edge of the shin guard comes to lie as close as possible to the corresponding surface of the shoe or foot. A gap that may be present between the shin element of the guard and the shoe or foot can in this case be bridged, for example, by a flexible area, for example by a nonwoven portion that belongs to the nonwoven padding of the inner side and that protrudes beyond the lower edge of the shin element.

A problem with such constructions is that the transition area between foot and shin guard is inadequate for the considerable loads, for example those that occur upon contact with a pole in slalom skiing, in particular because the distance between the shin guard and the upper edge of the shoe changes as a function of the angle of incidence between foot and lower leg and, accordingly, the gap is subjected to constant dynamic change.

DISCLOSURE OF THE INVENTION

It is accordingly an object of the present invention to make available an improved shin guard. In particular, the aim is to ensure better protection of the transition area between the foot or shoe of the user and the shin.

The underlying concept of the present invention is to form the shin guard from two stiff and hard elements, namely a shin element and a sliding element. Both elements are designed as surfaces curved substantially only in one direction, on the concave inner side of which surfaces the leg of the user comes to lie, while the outer side assumes the protective function. The two elements are mounted so as to be movable relative to each other along the axis of the shin guard, besides which the mounting is dynamic and spring-loaded, that is to say, in the relaxed state, the shin guard is at the maximum length and it can be shortened to an extent counter to the spring force.

When the upper part, the shin element, is fastened to the lower leg of the user, the sliding element is in other words dynamically movable in the axial direction for use. The sliding element is arranged such that it comes into abutment with the shoe or the foot of the user. If the angle between the foot or shoe and the leg of the user changes, and therefore the gap arranged in the transition area also changes, this gap always remains closed as a result of this dynamically movable bearing, and, even when the user crouches right down (no angle between foot and lower leg), there is no unpleasant opposing force caused by a shin guard lying in abutment.

Specifically, the present invention relates to a shin guard having a shin element which is based on a hard plastic (or metal or combination thereof) and has a concave inner side which is curved transversely with respect to a longitudinal axis of the shin guard and encloses an interior for accommodating the shin region of a user. The shin guard is here characterized in that, at the lower end directed toward the foot of the user, it has a separate plane sliding element, which is based on a hard plastic or metal and which has substantially the same width as the shin element. This sliding element has a concave inner side, which is adapted to the lower region of the shin element and is curved transversely with respect to the longitudinal axis of the shin guard, and also has a convex outer surface. Moreover, the shin guard is characterized in that the sliding element is mounted so as to be dynamically movable substantially along the longitudinal axis, within defined limits, counter to a spring force directed toward the foot.

A first preferred embodiment of this shin guard is characterized in that the sliding element is arranged so as to be movable with its convex outer surface running on the concave inner side, as it were sliding thereon. It can also be mounted so as to be movable parallel to (i.e. at a certain distance from) the concave inner side.

Generally speaking, it proves advantageous if, in the relaxed state of maximum length of the shin guard, the sliding element is arranged on the side of the shin element directed toward the interior and is therefore then covered at the front by the shin element in the axial direction, across an overlap area with an axial coverage length. This preferably across the entire width of the shin element. For maximum stability even under considerable loads, this coverage length in the longest coverage area is preferably 2-15 cm, preferably in the range of 5-10 cm.

Preferably, the sliding element can be moved along the longitudinal axis in a range of 0.5-10 cm, preferably in a range of 1-7 cm, particularly preferably in a range of 2-5 cm.

Preferably, in order to provide further protection, the sliding element, on the edge side facing outward during use, can have a downwardly directed extension part formed only in the edge area and covering the foot of the user in the direction of the outer ankle region, wherein the sliding element and this extension part are preferably formed in one piece.

According to another preferred embodiment, at least one guided spring mechanism arranged parallel to the longitudinal axis is provided on the inner side of the shin element. It is preferably not just one such spring mechanism that is provided, but several, preferably at least two or at least three such spring mechanisms distributed, preferably uniformly distributed, about the circumferential portion in the transition area.

The spring mechanism preferably comprises a spring element, for example in the form of a spiral spring, although an elastomer spring or a combination of such elements is also possible. Deflection mechanisms with elastic bands are also conceivable. The spring element is preferably mounted in a fastening, preferably in the form of a receiving formation or retainer on the inner side of the shin element with a downwardly open blind hole. Moreover, the spring element is braced against the sliding element, for example with direct or indirect abutment on the upper edge of the sliding element.

In order to protect the leg lying under it or the clothing lying under it, the spring mechanism can have a guide tube, in the interior of which the spring element is guided. The guide tube is preferably secured with its upper end in the fastening or connected thereto or forms part of this fastening, and with its lower end it is attached via a fastening element, typically a screw or rivet, to the shin element. On the side directed toward the shin element, the guide tube has a recess for the sliding element, and the sliding element has, for each fastening element (in the case of several spring mechanisms), an axially extending guide slit whose upper end and lower end define the limits for the axial mobility, since the lower fastening element of the guide tube passes through this slit.

The shin element and/or the sliding element can be made of a stiff plastics material, preferably a fiber-reinforced and/or fabric-reinforced plastics material, particularly preferably based on polyamide, polycarbonate, polyester, polyethylene, polypropylene or a mixture and/or a copolymer of such systems. In particular, glass-reinforced and/or carbon-fiber-reinforced materials based on these or other polymers can be used, and/or laminates of such materials, in which case identical or different materials can be used in different layers of the laminate.

A soft material can be arranged on the inner side of the shin element and/or sliding element, preferably in the form of at least an expanded foam, a foam layer, a woven layer, a nonwoven layer or a combination of such layers.

The soft material can be arranged on the inner side of the shin element in particular in such a way that it does not impede the axial mobility of the sliding element, preferably since it has a slit for the wall of the sliding element, or since it is cut out in the area of mobility of the sliding element.

Fastening elements for fastening the shin guard to the leg of the user are typically provided on the shin element. These fastening elements are, for example, fastening tabs and/or recesses arranged in pairs substantially at the same height, on which fastening straps, in particular woven straps, can be secured and/or guided through. Such fastening straps can, for example, be secured with Velcro fasteners, optionally in combination with elastic areas. The fastening straps can preferably also be provided, in particular on their inner side, with means that prevent slipping and/or increase friction (e.g. silicone prints, or woven-in elastic threads) in order to ensure a better hold of the guard on the leg of the user.

A further preferred embodiment is characterized in that fastening elements for fastening the shin guard to the user are provided on the shin element, wherein these fastening elements are arranged in the lower area for fastening to the shoe of the user. Such fastening elements can preferably be in the form of openings, particularly preferably with additional retaining lugs for easy engagement of laces, or in the form of fastening tabs for guiding through fastening laces.

Fastening elements for fastening the shin guard to the shoe of the user can also be provided on the sliding element.

On a convex outer side, the shin element can additionally have at least one stiff or partially elastic rib (or crest) which preferably extends over substantially the entire axial length of the shin element and is raised above the surface, preferably in the form of a rib of substantially pyramidal cross section with an axially extending tip. This rib can be formed in one piece with the shin element and made from the same material or can be secured (for example by adhesive bonding, screwing, riveting or the like) as a separate element on the outer side of the shin element. The rib itself can be made from a material that minimizes friction or can be coated with such a material (e.g. rib made of aluminum, e.g. coated with PTFE). This gives rise to further options, specifically of exchanging the ribs after they have become worn or adapting them to the properties of the gate poles that have to be deflected. Moreover, the ribs can thus be secured on the shin element in a preferably detachable and exchangeable manner. For example, with a detachable clamping mechanism, locking mechanism, snap-fit mechanism, sliding locking mechanism or sliding snap-fit mechanism, with easily releasable screws, nuts, slides or the like, without extensive use of tools or destruction of the component parts releasable mechanisms. Moreover, the ribs can be made in different shapes and heights, so as to be able to individually adapt the guard by exchanging them, and so as to ensure that the properties of the latter can be adapted flexibly to the requirements.

A stiff or partially elastic rib (or crest) of this kind which is arranged on a convex outer side of the shin element, preferably extends over substantially the entire axial length of the shin element and is raised above the surface, preferably in the form of a rib of substantially pyramidal cross section with an axially extending tip, is also an invention independently of a dynamic bearing the sliding element substantially along the longitudinal axis, within defined limits, counter to a spring force directed toward the foot, particularly if the ribs are secured exchangeably. Independently of the above, the invention thus also relates to a shin guard having a shin element which is based on a hard plastic or metal and has a concave inner side which is curved transversely with respect to a longitudinal axis of the shin guard and encloses an interior for accommodating the shin region of a user, characterized in that, on a convex outer side of the shin element, at least one stiff rib is provided which preferably extends over substantially the entire axial length of the shin element and is raised above the surface, said rib preferably being in the form of a rib of substantially pyramidal cross section with a substantially axially extending tip, wherein this rib is secured, as an exchangeable separate element, on the outer side of the shin element. This rib can be made from the same material and can be secured (for example by adhesive bonding, screwing, riveting or the like) as a separate element on the outer side of the shin element. Here too, the rib itself can be made from a material that minimizes friction or can be coated with such a material (e.g. rib made of aluminum, e.g. coated with PTFE). This gives rise to the abovementioned further options, specifically of exchanging the ribs after they have become worn or adapting them to the properties of the gate poles that have to be deflected. Moreover, the ribs can thus be secured on the shin element in a preferably detachable and exchangeable manner. Here too, for example, with a detachable clamping mechanism, locking mechanism, snap-fit mechanism, sliding locking mechanism or sliding snap-fit mechanism, with easily (if appropriate manually) releasable screws, nuts, slides or the like, without extensive use of tools or destruction of the component parts releasable mechanisms. Moreover, the ribs can be made in different shapes and heights, so as to be able to individually adapt the guard by exchanging them, and so as to ensure that the properties of the latter can be adapted flexibly to the requirements. In other respects, a construction of this kind can have the same preferred features as those described in connection with the main invention, namely fastening straps, soft inner padding, edge protector, etc.

At its lower edge coming into contact with the foot and/or shoe of the user, which lower edge is preferably slightly concave to receive the instep, the sliding element can have an edge protector, preferably in the form of a material strip of metal and/or plastic, preferably a fiber-reinforced or fabric-reinforced plastic, engaging around the edge.

The invention further relates to a pair of two shin guards of the kind set out above and of mirror symmetry.

Further embodiments are set forth in the dependent claims.

BRIEF DESCRIPTION OF THE DRAWINGS

Preferred embodiments of the invention are described below with reference to the drawings, which serve only for illustration and are not to be interpreted as limiting the invention. In the drawings.

DESCRIPTION OF PREFERRED EMBODIMENTS

Figure 1:
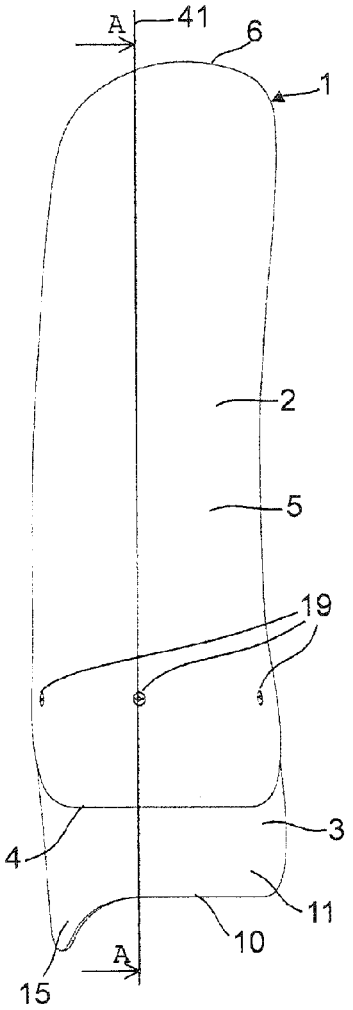
FIG. 1 shows a front view of a shin guard.
Figure 2:
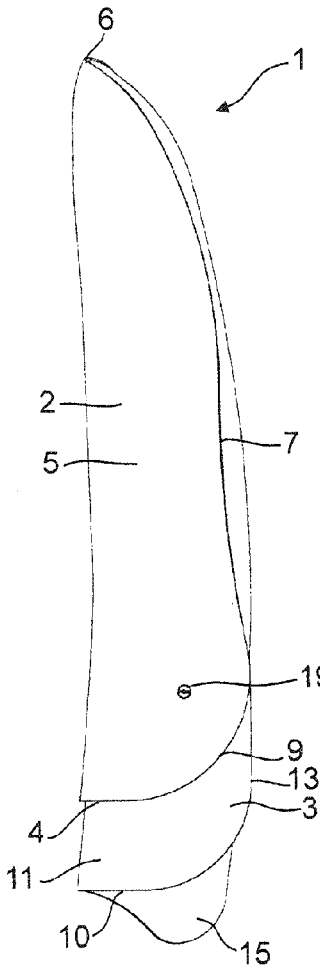
FIG. 2 shows a side view from the inner side (relative to a user wearing the guard)
Figure 3:
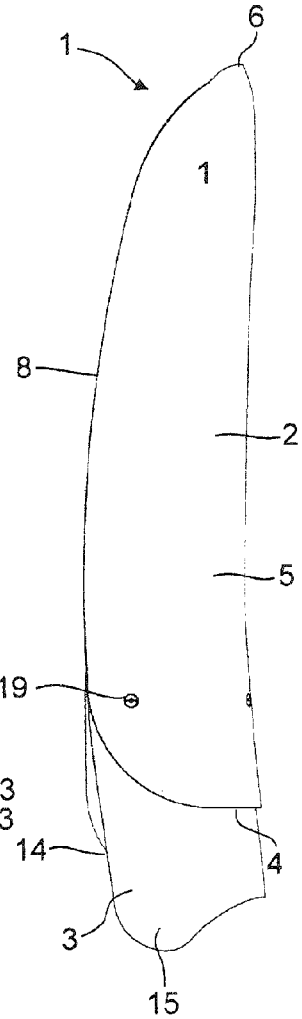
FIG. 3 shows a side view from the outer side (relative to a user wearing the guard)
Figure 4:
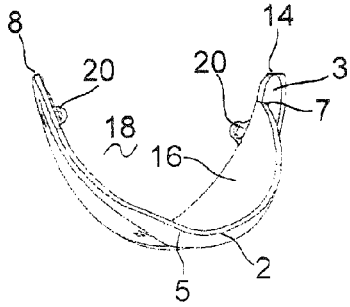
FIG. 4 shows a view from above.
Figure 5:
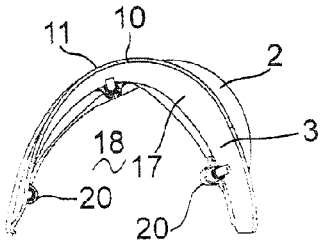
FIG. 5 shows a view from below.

An illustrative embodiment of a shin guard according to the invention is shown in the figures. The shin guard 1 comprises a shin element 2, which forms the upper element of the shin guard directed toward the knee of the user. On the lower side, i.e. on the side directed toward the foot of the user, another similarly stiff protection element is provided, namely the sliding element 3. Both elements are designed to some extent as tunnel-shaped elements and enclose an interior 18 in which the leg of the user lies.

The shin element 2 has an outer side 5, which is convex, and an inner side 16, which is concave. The overall design is ergonomic, and the element extends along a longitudinal axis 41 from the upper edge 6, which is typically rounded, to the lower edge 4, which is typically straight, at least in the central area.

The figures show a shin guard for the right leg of a user; the corresponding protection element for the left shin has a mirror symmetrical design to this.

The side edges are arranged on the respective sides, namely the side edge 7 on the inner side and the outer edge 8 on the outer side. The transition between the respective side edge 7/8 and the lower edge 4 is rounded; the same applies to the transitions to the upper edge 6.

The sliding element 3 is provided below and adjacent to the shin element 2 and to an extent arranged behind the latter. The sliding element 3 is adapted in terms of its curvature to the lower area of the shin element 2 and has a lower edge 10 directed toward the foot and typically coming into close contact with the shoe. This lower edge 10 is slightly concave in order to match the rounded upper side of the shoe. Moreover, this lower edge 10 widens on the outer side, i.e. directed laterally toward the ankle, via an outer extension part 15 which extends still farther downward and serves for additional protection of the outer area.

The sliding element 3 also has a convex outer surface 11, an upper edge 12, an inner side edge 13, and an outer side edge 14. FIGS. 1 to 10 show an illustrative embodiment, with each of these figures using corresponding reference signs for the same elements. In the position shown, the shin guard is at its maximum length, i.e. the sliding element 3 is moved down to the maximum extent and at its lower abutment.

Figure 6:
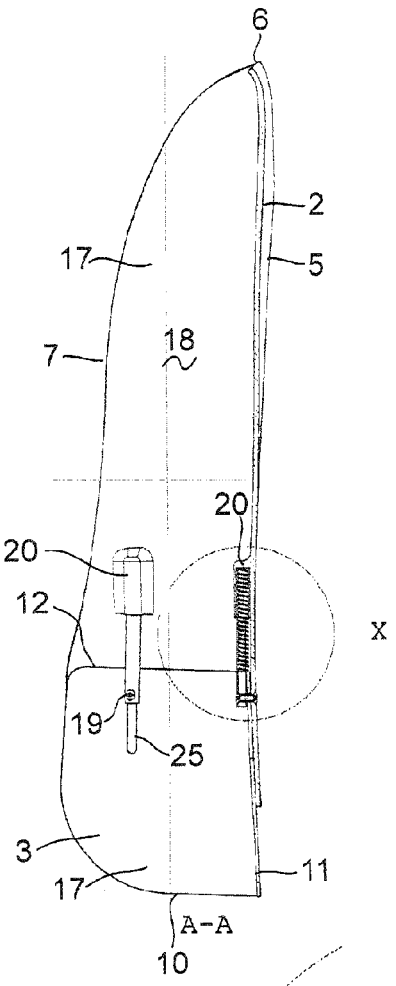
FIG. 6 shows an axial section along the line A-A in FIG. 1.
Figure 7:
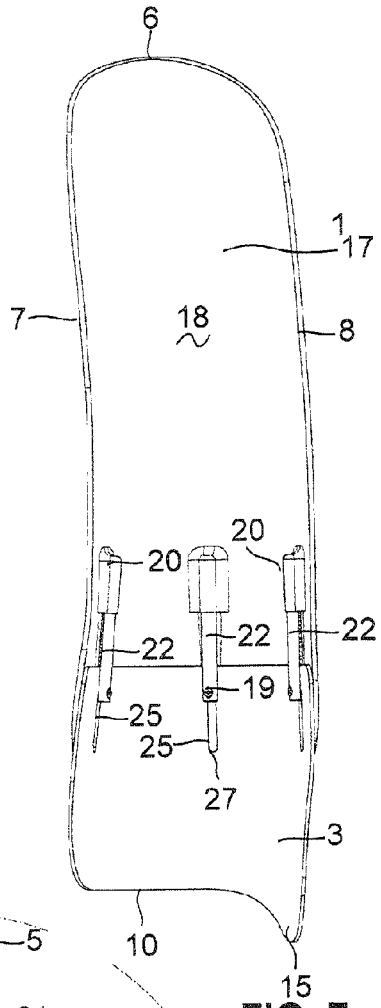
FIG. 7 shows a view from behind into the shin guard.
Figure 8:
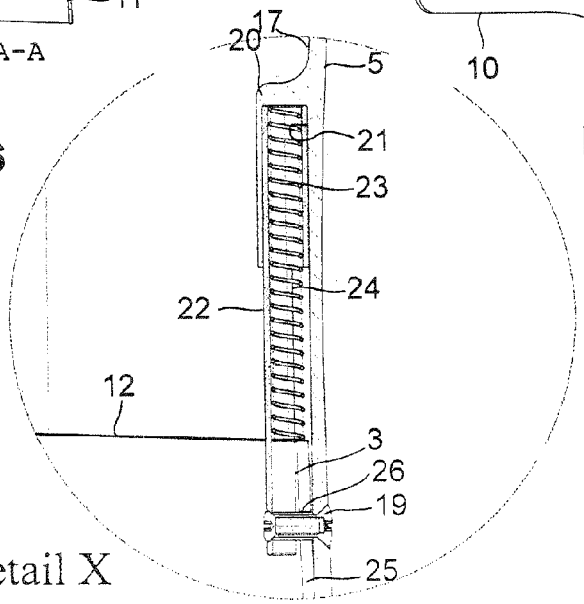
FIG. 8 shows a detail, corresponding to the circle X in FIG. 6, for illustrating the spring mechanism.
Figure 9:
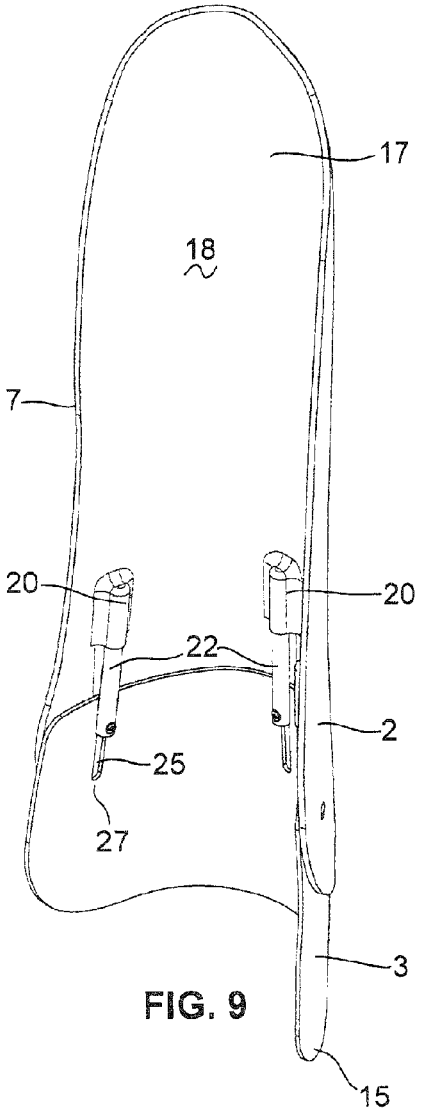
FIG. 9 shows a perspective view into the interior from the outer side.
Figure 10:
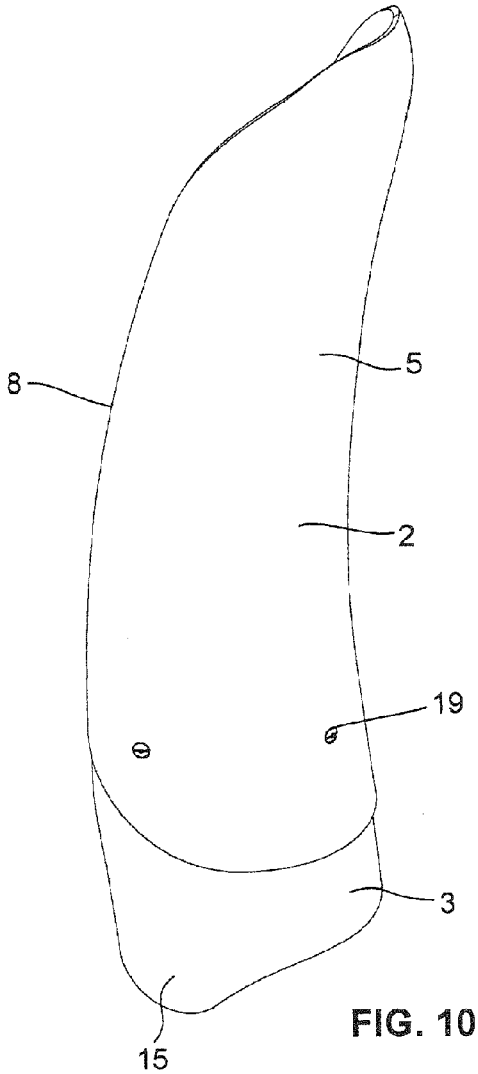
FIG. 10 shows a perspective view of the outer side.

This sliding element 3 is mounted movably relative to the shin element 2, specifically with spring pretensioning, for which purpose a mechanism is provided which can best be understood from FIGS. 6 to 8.

In this case, receiving formations 20 are provided on the inner side 17 of the shin element 2, specifically three such elements, distributed as it were about the circumference, each of these making available a downwardly open recess in the form of a blind hole 21. These fastenings 20 are arranged in the lower half of the shin element 2.

Generally speaking, the shin element 2 has an axial length that is approximately at least twice as great, preferably at least four times as great, as the axial length of the sliding element 3.

A guide tube 20, for example made of aluminum or a plastic, is secured in these receiving formations 20; this can be done with an interference fit, adhesive bonding or else also by screwing. These guide tubes 22 extending as far as the sliding element 3 serve as a seat for a spiral spring 23, which at the top is in abutment with the base of the fastening 20, unless the guide tube 22 has a bottom surface.

In the lower area, i.e. in that area of the guide tube 22 not engaged in the blind hole 21, the guide tube 22 is cut out on the side directed toward the shin element 2, i.e. there is a recess 24 here which as it were makes available a slit between the wall of the shin element 2 and the tube 22. The corresponding wall portion of the sliding element 3 migrates in this slit. The lower part of the guide tube 22 is connected by a screw 19 to the corresponding wall portion of the shin element 2. On the other side, this screw 19 passes through an elongate guide slit 25 in the sliding element 3. This guide slit 25 is arranged substantially axially and has an upper end in the form of an upper abutment 26 and a lower end in the form of a lower abutment 27. The guide slits 25 of the various spring mechanisms are arranged in parallel.

As has already been mentioned above, the shin guard 1 in the form shown in the figures is at the outermost abutment, i.e. the sliding element 3 is arranged as far down as possible, the spring 23 is relaxed to the maximum extent, and, accordingly, the screw 19 is in abutment with the upper abutment 26 of the slit 25. The underside of the spring 23 is in fact in abutment with the upper edge 12 of the sliding element 3 and presses the latter into the maximum abutment position at the edge 26, unless a counterforce is applied to the sliding element 3 from below.

If the sliding element 3 is now pushed upward from below, for example because the user reduces the angle of incidence between the shin and the foot, the sliding element 3 moves behind the shin element 2 counter to the spring force of the spring 23. It is optimally guided by the guide slits 25, which in this case are three in number, and, accordingly, as a result of this spring-cushioned mobility, a slit can never form between shin and foot, and no disturbance can be caused through a counterpressure resulting from there being too small an angle between lower leg and foot.

A shin guard structure of this kind has to be fastened to the user. This is done, on the one hand, by woven straps which are fastened to fastening tabs 37 shown in FIG. 15 or are guided through guide slits 39 provided in these and, for example, are secured with Velcro fasteners, optionally in combination with elastic areas.

Figure 11:
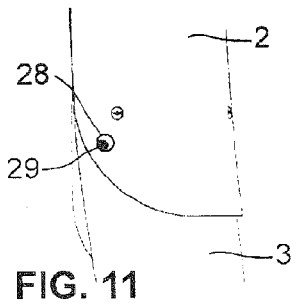
FIG. 11 shows a first possible fastening device.
Figure 12:
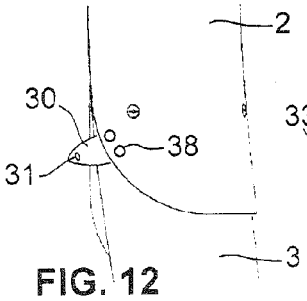
FIG. 12 shows a second possible fastening device.
Figure 13:
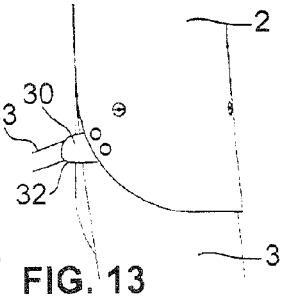
FIG. 13 shows a third possible fastening device.
Figure 15:
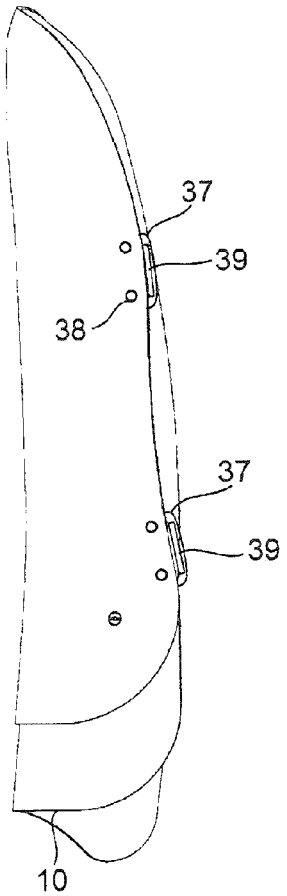
FIG. 15 shows a side view with the lateral fastening elements.

In addition to the fastening tabs 37 arranged in the upper area as shown in FIG. 15, it is also possible to provide fastenings in the lower area for fastening to the shoe, as are shown in FIGS. 11 to 13. A simple fastening possibility can be realized by providing an opening 28 (cf. FIG. 11) which has a lug-shaped widening 29. A fastening lace, for example of Dyneema, can in this case easily be pushed from one side into this hole as an eyelet and engaged over the lug, i.e. the fastening lace does not then have to be threaded through the hole.

An alternative construction is the fastening of a tab 30, which is specially provided for this purpose, with a fastening opening 31, as is shown in FIG. 12.

A further fastening possibility is a tab 30 (cf. FIG. 13) which is made of metal, for example, and is rolled once at its outer end such that a terminal fastening sleeve 32 forms, through which a lace 33 can be pulled, and the structure can be secured on the shoe with this cord.

Figure 14:
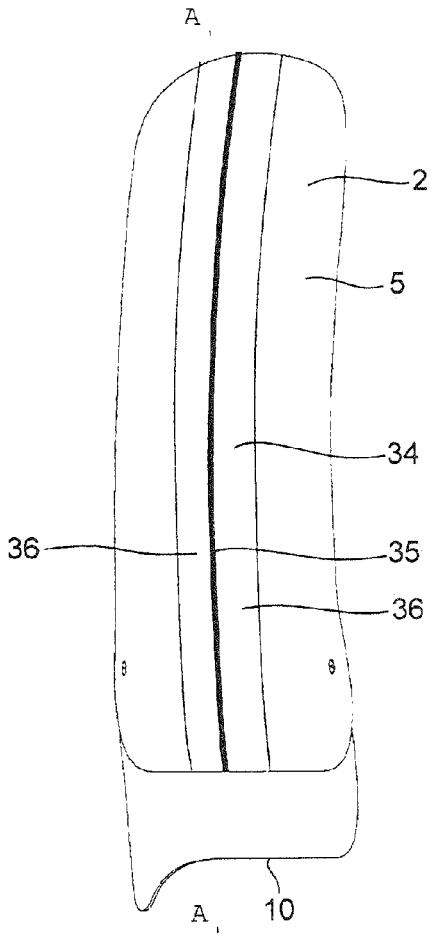
FIG. 14 shows a front view of an illustrative embodiment with an axial crest.
Figure 14A:
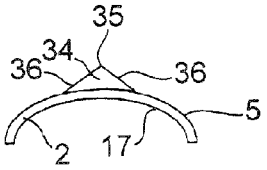
FIG. 14*a* shows a horizontal section through a shin element according to FIG. 14.
Figure 16:
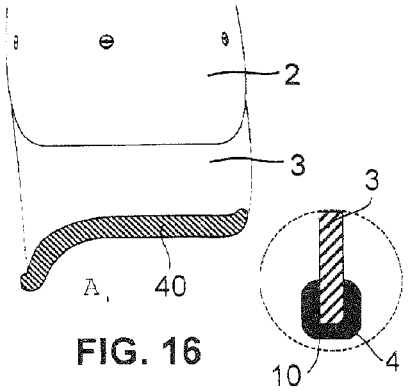
FIG. 16 shows a front view illustrating the edge protector for the sliding element, with a cross-sectional view in the circle.

A further improvement, particularly for slalom skiing, can be achieved if a solid central rib 34 is arranged on the outer surface 5 of the shin element, as is shown in FIGS. 14 and 14*a*. This rib can optimally take up the impact forces of the pole, since it has a crest 35 and two lateral flanks 36, and the rib can either be completely stiff or also slightly elastic, depending on the type of use.

The considerable loads during use mean that particular attention has to be paid to the lower edge 10 of the sliding element. If the material from which the sliding element 3 is made does not easily withstand these mechanical loads, it may prove advantageous to provide an edge protector 40 serving specially to protect this edge. For example, this edge protector 40 can be in the form of a layer of material, for example a fiber-reinforced plastic, engaging around the edge.

LIST OF REFERENCE NUMERALS

1 shin guard
2 shin element, upper element of 1
3 sliding element, lower element of 1
4 lower edge of 2
5 convex outer surface of 2
6 upper edge of 2
7 inner side edge of 2
8 outer side edge of 2
9 rounded transition area
10 lower edge of 3
11 convex outer surface of 3
12 upper edge of 3
13 inner side edge of 3
14 outer side edge of 3
15 outer extension part downward from 10
16 concave inner side of 2
17 concave inner side of 3
18 interior of 1
19 fastening screw
20 receiving formation
21 receiving opening of 20, downwardly open blind hole
22 guide tube
23 spring element, spiral spring
24 recess in 22
25 guide slit in 3
26 upper abutment of 25
27 lower abutment of 25
28 fastening opening
29 lug in 28
30 lower fastening tab
31 fastening opening in 30
32 fastening sleeve in 30
33 lace
34 axial crest
35 tip of 34
36 flanks of 34
37 upper fastening tab
38 fastening screw/fastening rivet
39 guide slit in 37
40 edge protector on 10
41 longitudinal axis of 1

The invention claimed is:

1. A shin guard for protection of a transition area between a foot or shoe of a user and a shin of the user, comprising:

a shin element which comprises a hard plastic or metal and has a concave inner side which is curved transversely with respect to a longitudinal axis of the shin guard and encloses an interior for accommodating the shin region of a user, a sliding element, provided at a lower end of the shin element directed toward the foot of the user, having a same width as the shin element, which sliding element comprises a hard plastic or metal and has a concave inner side, is adapted to the lower region of the shin element and is curved transversely with respect to said longitudinal axis of the shin guard, also encloses an interior for accommodating the shin region of a user, and also has a convex outer surface, wherein the sliding element, in use coming into abutment with said foot or shoe of the user, is mounted on said shin element slidably along said longitudinal axis relative to the shin element, within defined limits between an extended state of maximum length of the shin guard and a compressed state of minimum length of the shin guard, against a spring force directed toward said foot of the user, wherein the sliding element is mounted so as to be movable with a convex outer surface running on or parallel to the concave inner side of said shin element, and wherein, in the extended state of maximum length of the shin guard, the sliding element on a convex outer side is covered by the concave inner side of said shin element over the full width of the shin guard in an overlap area, wherein at least three guided spring mechanisms are arranged parallel to the longitudinal axis on the inner side of the shin element and are distributed around the axis, and wherein each guided spring mechanism is mounted in a fastening section formed on the inside of the shin element, said fastening section having a blind hole open towards the sliding element, in which blind hole a spiral spring is located in a guide tube, said spiral spring being braced against the sliding element.

2. The shin guard as claimed in claim 1, wherein the sliding element can be moved along the longitudinal axis in a range of 0.5-10 cm.

3. The shin guard as claimed in claim 1, wherein the sliding element, on an outer side facing outward during use, has an extension part formed only in an edge area and covering the foot of the user in the direction of the outer ankle area.

4. The shin guard as claimed in claim 1, wherein the guide tube is secured with its upper end in the fastening section and with its lower end with a fastening element to the shin element, wherein the guide tube, on a side directed toward the shin element, has a recess for the sliding element, and wherein the sliding element has, for each fastening element, an axially extending guide slit whose upper end and lower end define the extended state of maximum length of the shin guard and a compressed state of minimum length of the shin guard.

5. The shin element as claimed in claim 1, wherein the shin element and/or the sliding element are made from a stiff plastics material.

6. The shin guard as claimed in claim 1, wherein the shin element and/or the sliding element are made from a stiff plastics material, and a soft material is arranged on the inner side of the shin element and/or sliding element.

7. The shin guard as claimed in claim 1, wherein fastening elements for fastening the shin guard to the leg of the user are provided on the shin element.

8. The shin guard as claimed in claim 1, wherein fastening elements for fastening the shin guard to the user are provided on the shin element, wherein these fastening elements are arranged in the lower area for fastening to the shoe of the user.

9. The shin guard as claimed in claim 1, wherein fastening elements for fastening the shin guard to the shoe of the user are provided on the sliding element.

10. The shin guard as claimed in claim 1, wherein, on a convex outer side of the shin element, at least one stiff rib is provided which is raised above the surface.

11. The shin guard as claimed in claim 1, wherein the sliding element, at its lower edge coming into contact with the foot and/or shoe of the user, has an edge protector.

12. A pair of two shin guards, of mirror symmetry, as claimed in claim 1.

13. The shin guard as claimed in claim 1, wherein the sliding element, in the extended state of maximum length of the shin guard is covered at the front in the axial direction over a length in the range of 2-15 cm.

14. The shin guard as claimed in claim 1, wherein the sliding element, in the extended state of maximum length of the shin guard is covered at the front in the axial direction over a length in the range of 5-10 cm.

15. The shin guard as claimed in claim 1, wherein the sliding element can be moved relative to the shin element along the longitudinal axis in a range of 1-7 cm.

16. The shin guard as claimed in claim 1, wherein the sliding element can be moved relative to the shin element along the longitudinal axis in a range of 2-5 cm.

17. The shin guard as claimed in claim 1, wherein the sliding element, on the outer side facing outward during use, has an extension part formed only in an edge area and covering the foot of the user in the direction of an outer ankle area, wherein the sliding element and this extension part are formed in one piece.

18. The shin element as claimed in claim 1, wherein the shin element and/or the sliding element are made from a stiff fiber-reinforced and/or fabric-reinforced plastics material.

19. The shin element as claimed in claim 1, wherein the shin element and/or the sliding element are made from a stiff fiber-reinforced and/or fabric-reinforced plastics material, based on polyamide, polycarbonate, polyester, polyethylene, polypropylene or a mixture and/or or a copolymer of such systems, and/or based on glass-reinforced and/or carbon-fiber-reinforced materials and/or as laminates.

20. The shin guard as claimed in claim 1, wherein the shin element and/or the sliding element are made from a stiff plastics material, and a soft material is arranged on the inner side of the shin element and/or sliding element, in the form of at least an expanded foam, a foam layer, a woven layer, a nonwoven layer or a combination of such layers, wherein the soft material is arranged on the inner side of the shin element in such a way that it does not impede the axial mobility of the sliding element, since it has a slit for the wall of the sliding element, or since it is cut out in the area of mobility of the sliding element.

21. The shin guard as claimed in claim 1, wherein fastening elements for fastening the shin guard to the leg of the user are provided on the shin element, wherein these fastening elements are fastening tabs and/or recesses arranged in pairs at the same height, on which fastening straps, including woven straps, can be secured and/or guided through, wherein the fastening straps can be secured with Velcro fasteners.

22. The shin guard as claimed in claim 1, wherein fastening elements for fastening the shin guard to the user are provided on the shin element, wherein these fastening elements are arranged in the lower area for fastening to the shoe of the user, and wherein the fastening elements are in the form of openings, with additional retaining lugs, or in the form of fastening tabs for guiding through fastening laces.

23. The shin guard as claimed in claim 1, wherein, on a convex outer side of the shin element , at least one stiff rib is provided which extends over substantially the entire axial length of the shin element and is raised above the surface, in the form of a rib of substantially pyramidal cross section with a substantially axially extending tip, wherein this rib is formed in one piece with the shin element and made from the same material or is secured, as an exchangeable separate element, on the outer side of the shin element.

24. The shin guard as claimed in claim 1, wherein the sliding element, at its lower edge coming into contact with the foot and/or shoe of the user, has an edge protector, in the form of a material strip of metal and/or plastic, including a fiber-reinforced or fabric-reinforced plastic, engaging around the edge.

* * * * *